US007077117B1

(12) United States Patent
Chu

(10) Patent No.: US 7,077,117 B1
(45) Date of Patent: Jul. 18, 2006

(54) DETACHABLE DRIVING ASSEMBLY FOR A TOY GUN

(76) Inventor: Chen-Tang Chu, No. 26-8, Fongdong Rd., Fongyuan, Taichung Hsien (TW)

( * ) Notice: Subject to any disclaimer, the term of this patent is extended or adjusted under 35 U.S.C. 154(b) by 6 days.

(21) Appl. No.: 11/023,561

(22) Filed: Dec. 29, 2004

(51) Int. Cl.
*F41A 19/00* (2006.01)

(52) U.S. Cl. ..... 124/32; 124/31

(58) Field of Classification Search ..... 446/473, 446/491; 124/31, 16, 27, 32
See application file for complete search history.

(56) References Cited

U.S. PATENT DOCUMENTS 2,092,872 A * 9/1937 Bonnett ..... 446/23
3,026,640 A * 3/1962 Ogdon ..... 40/502
3,029,539 A * 4/1962 Glass et al. ..... 42/57
5,261,384 A * 11/1993 Hu ..... 124/66
5,283,970 A * 2/1994 Aigner ..... 42/57
6,564,788 B1 * 5/2003 Hu ..... 124/66
6,695,676 B1 * 2/2004 Blake ..... 446/473

* cited by examiner

*Primary Examiner*—Michael J. Carone
*Assistant Examiner*—Stewart Knox
(74) *Attorney, Agent, or Firm*—Troxell Law Office, PLLC

(57) ABSTRACT

A detachable driving assembly for a toy gun has a first casing containing a piston device and a second casing containing a gear set. The first casing and the second casing are detachably combined by a pin and a levering lock. The piston device has a piston body with a spring and a toothed rack formed under the piston body. The gear set mainly comprises a miter gear, a reduction gear and a half-toothed gear sequentially rotated by a motor to drive the piston device. The half-toothed gear has a periphery, multiple teeth partially formed on the periphery, and an idle area formed on a remainder of the periphery. Thereby, when the teeth engage with the toothed rack to run with the half-toothed gear, the piston device is driven to a compressed condition. When the half-toothed gear enters the idle area, the piston device is released to punch a projectile.

8 Claims, 8 Drawing Sheets

DETACHABLE DRIVING ASSEMBLY FOR A TOY GUN

BACKGROUND OF THE INVENTION

1. Field of the Invention

The invention relates to a driving assembly for a toy gun, and more particularly to a driving assembly that is detachable and efficient.

2. Description of Related Art

A conventional driving assembly of a toy gun mainly comprises a piston device and a power-transmitting device. The piston device and the power-transmitting device are co-operated and mounted within a pair of symmetrical casings to compose the toy gun. Therefore, the piston device and the power-transmitting device are not separable from each other after both devices are attached inside the toy gun.

When the toy gun is used over a long period of time, the power-14 transmitting device needs to be cleaned and repaired. With regard to the undetachable situation of the conventional driving assembly, repairing the toy gun is troublesome and time-consuming because the whole toy gun has to be disassembled. Moreover, the power-transmitting device is easily worn out because of abrasion and the piston device can no longer be activated precisely and powerfully.

The present invention has arisen to provide a detachable driving assembly for a toy gun to eliminate or obviate the drawbacks of the conventional driving assembly.

SUMMARY OF THE INVENTION

The main objective of the present invention is to provide a detachable driving assembly that can be disassembled easily.

Another objective of the present invention is to provide a detachable driving assembly that transmits power efficiently.

Further benefits and advantages of the present invention will become apparent after a careful reading of the detailed description in accordance with the drawings.

DETAILED DESCRIPTION OF THE PREFERRED EMBODIMENT

A detachable driving assembly for a toy gun in accordance with the present invention comprises a first casing containing a piston device and a second casing containing a gear set. The first casing and the second casing are detachably combined by a pin and a levering block. The piston device has a piston body with a spring and a toothed rack formed under the piston body. The gear set mainly comprises a miter gear, a reduction gear and a half-toothed gear sequentially rotated by a motor to drive the piston device. The half-toothed gear has a periphery, multiple teeth partially formed on a first portion of the periphery, and an idle area formed on a second portion of the periphery. Thereby, when the teeth engage with the toothed rack, the piston device is driven by the gear set to a compressed condition. When the half-toothed gear enters the idle area, the piston device is released from the compressed condition.

Figure 1:
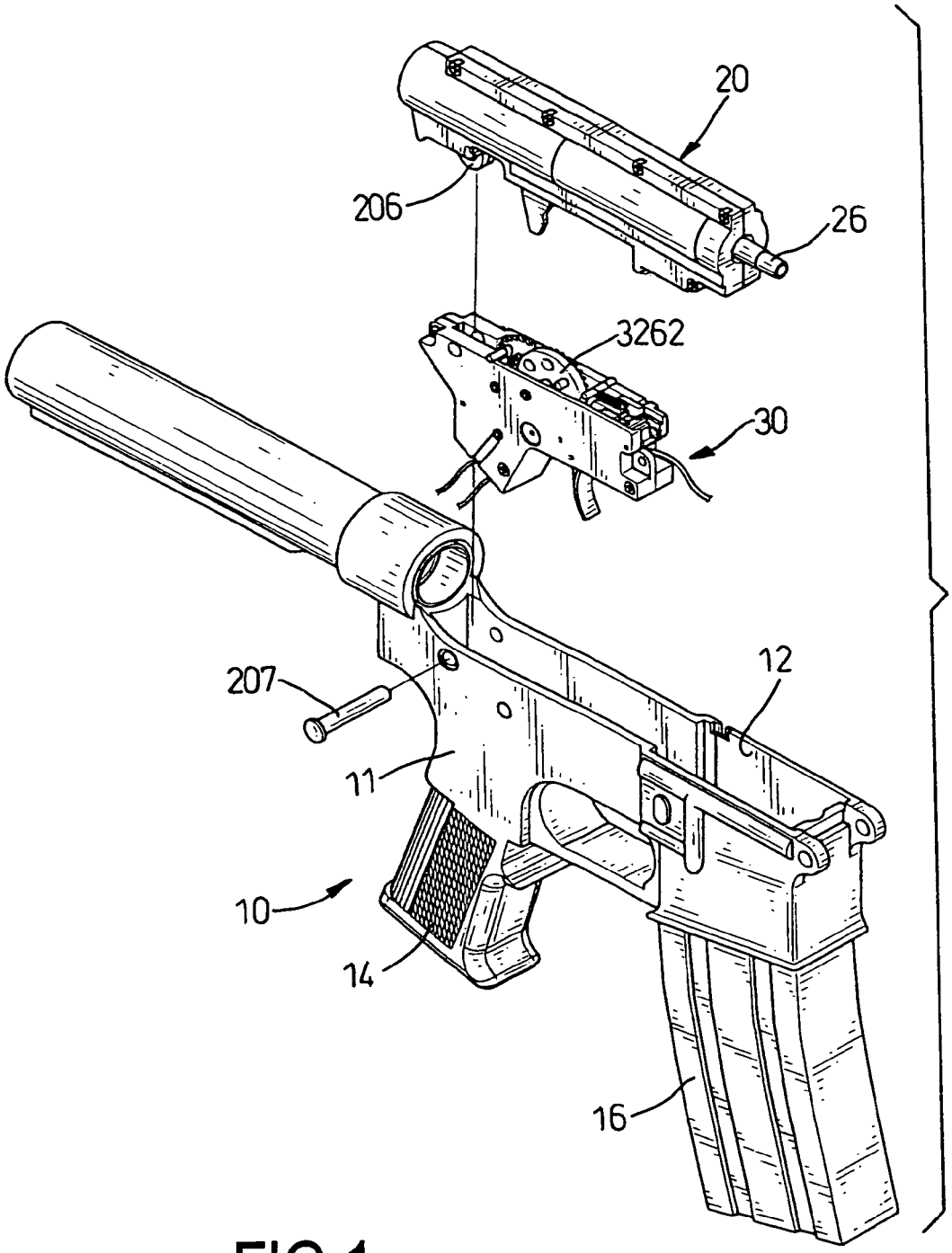
FIG. 1 is an exploded perspective view of a toy gun containing a detachable driving assembly in accordance with the present invention.
Figure 2:
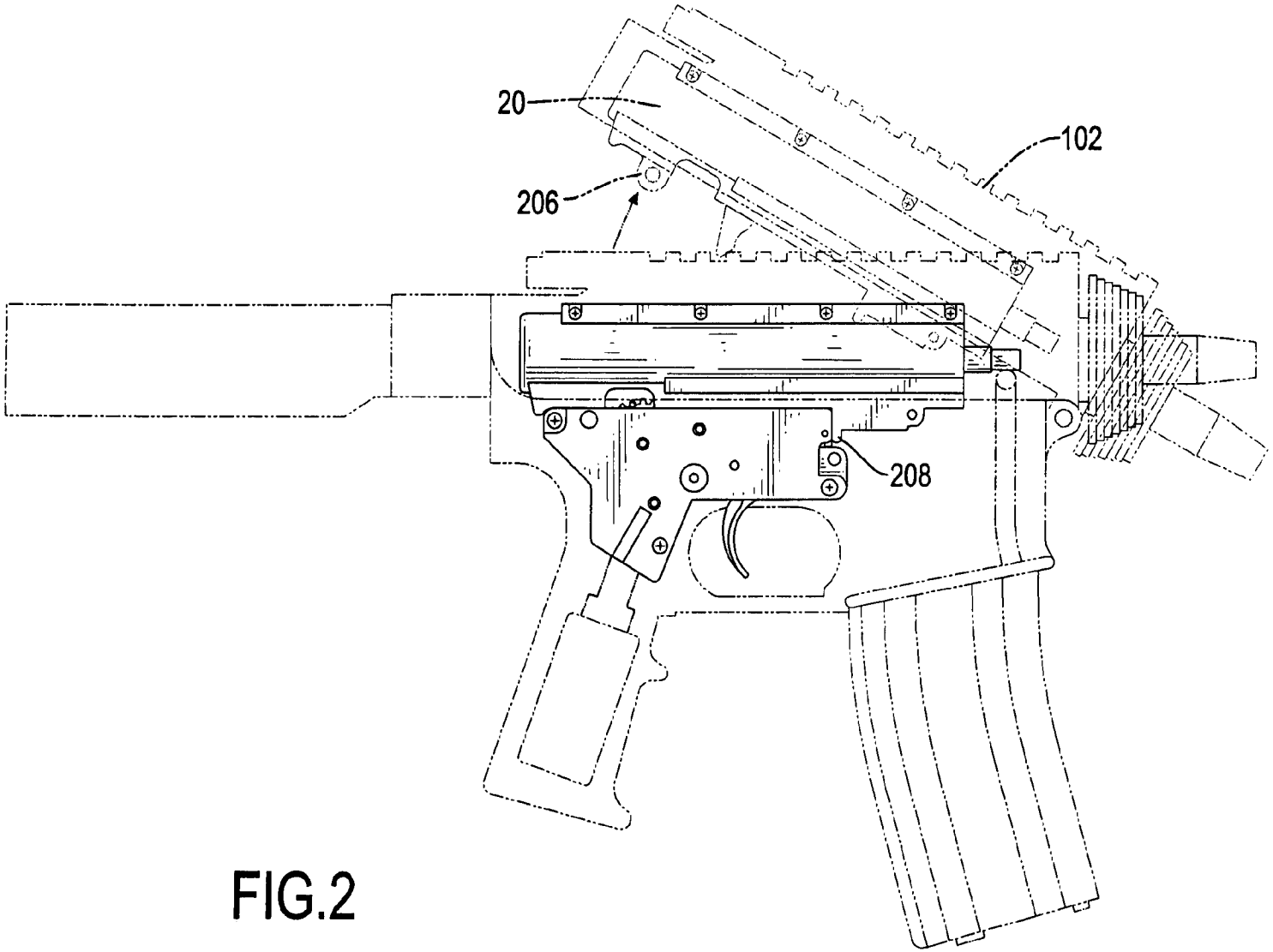
FIG. 2 is a partially cross-sectional side view of the toy gun in FIG. 1, wherein the broken lines show an operational movement of the toy gun.
Figure 3:
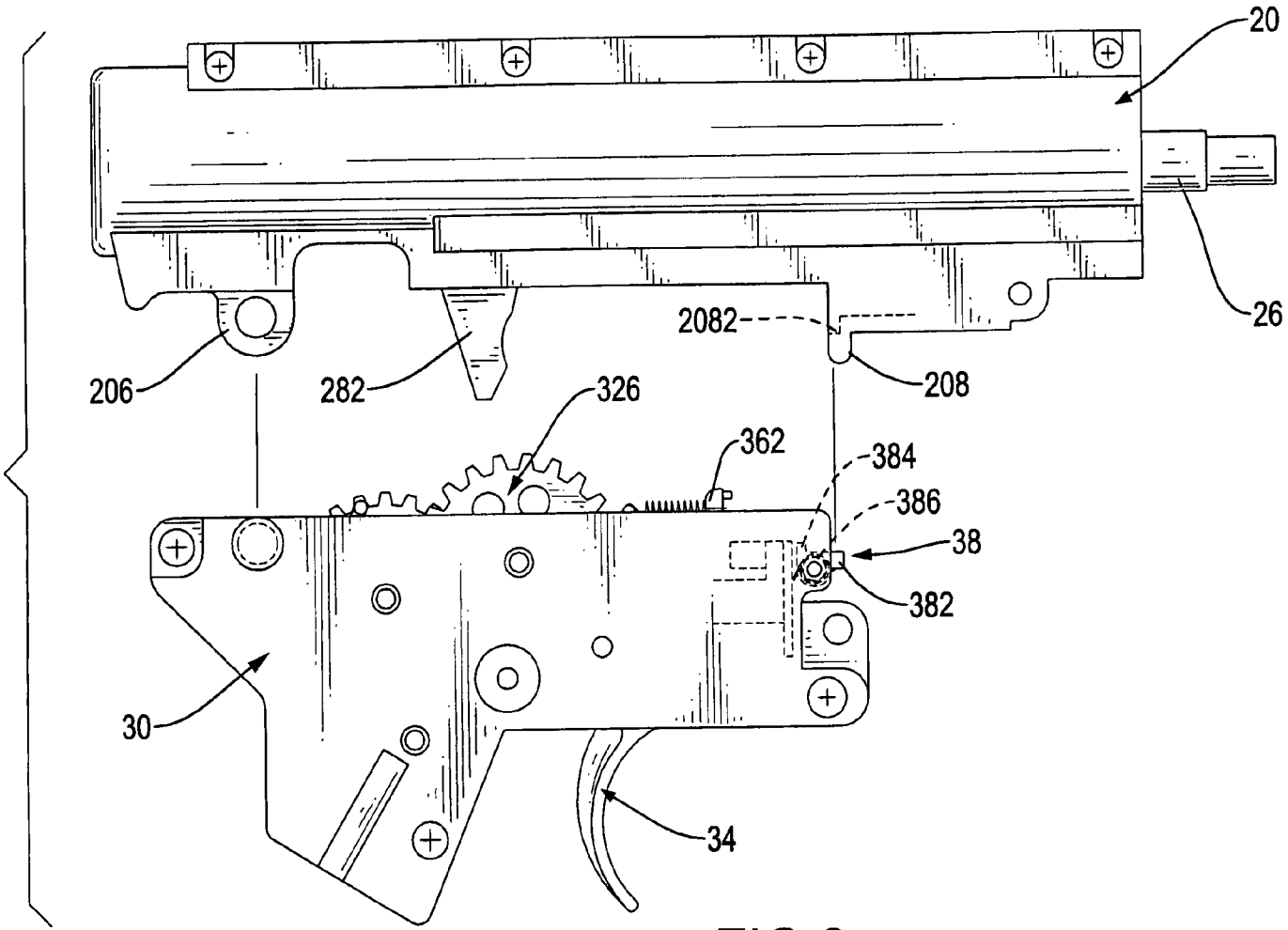
FIG. 3 is an operational side view showing detachment of the driving assembly in FIG. 1.

With reference to FIGS. 1 to 3, a preferred embodiment of the detachably driving assembly in accordance with the present invention is adapted to be mounted on a gun body (10) and mainly comprises a first casing (20) containing a piston device and a second casing (30) containing a gear set.

The gun body (10) has a body (11) with a recess (12), a cover (102) mounted over the recess (12), a bottom, a front end and a rear end, a handle (14) formed under the bottom, a cassette (16) detachably mounted under the bottom at the front end to provide projectiles, i.e. BB bullets (162), into the recess (12). Because the gun body (10) and the cassette (16) are well-known for a person skilled in the field, redundant descriptions are avoided here. Moreover, a power supplier (142) is received inside the handle (14) to electrically drive the gear set inside the second casing (30).

Figure 4:
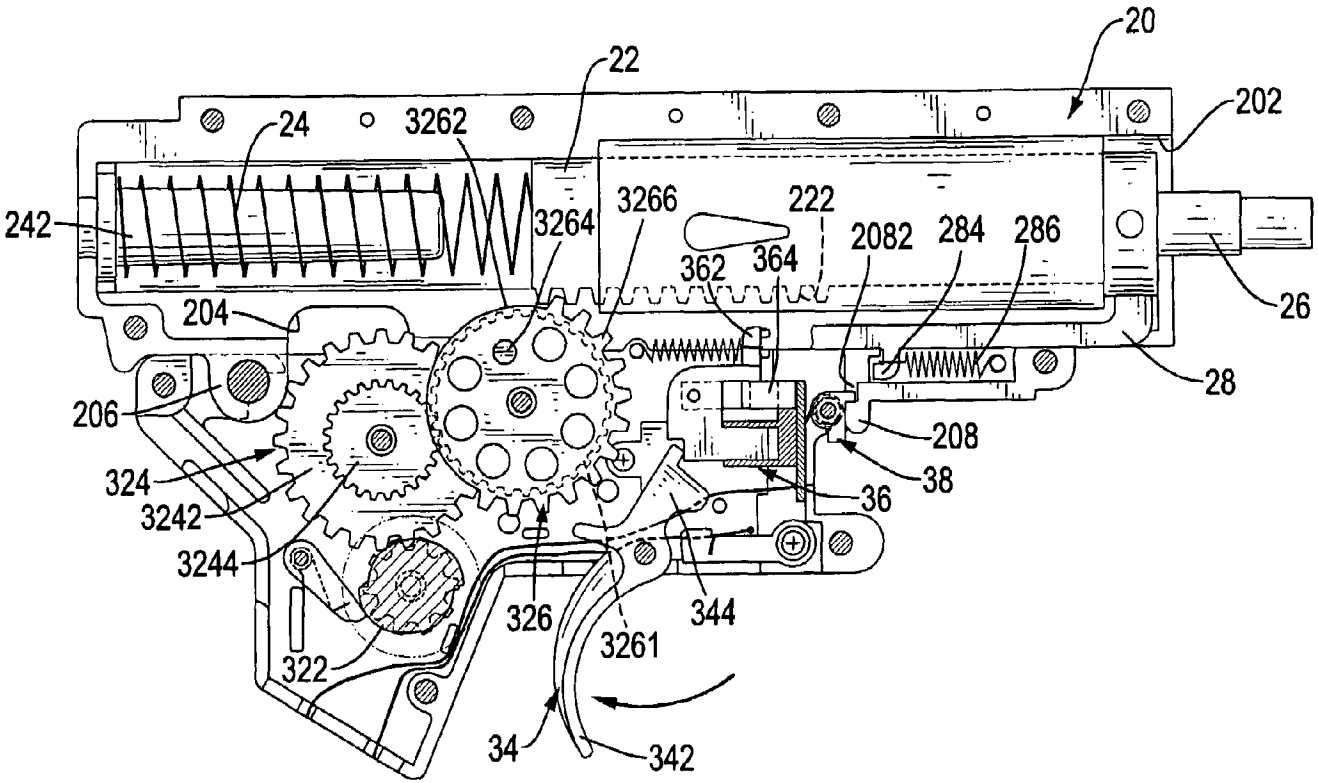
FIG. 4 is an operational cross-sectional side view of the detachable driving assembly, wherein a trigger is pushed to achieve an electrical connection.

With further reference to FIG. 4, the first casing (20) is a substantially cylindrical barrel and has a front end, a front opening (202), a rear end, a bottom, a bottom slit (204), a sheet (206), and an abutting arm (208). The front opening (202) is defined in the front end and the bottom slit (204) is defined in the bottom of the first casing (20). The sheet (206) is formed on the bottom at the rear end and the abutting arm (208) is protruded from the bottom at the front end to extend backward. The abutting arm (208) further has a distal end and a cutout (2082) formed at the distal end.

The first casing (20) is mounted over the recess (12) of the gun body (10) and contains a piston body (22), a spring (24), an optional spring tube (242), a nozzle (26) and a driving shaft (28). The piston body (22) is received inside the first casing (20) at the front end and has a bottom and a toothed rack (222) formed on the bottom of the piston body (22). The spring (24) is clamped between the piston body (22) and the rear end of the first casing (20) to provide a restitution force to the piston body (22). To keep the spring (24) straight without bias, the spring tube (242) is attached at the rear end inside the first casing (20) to partially penetrate the spring (24). The nozzle (26) is mounted in front of the piston body (22), extended out of the first casing (20) via the front opening (202), and retractable to operationally reload shooting object (162) inside the gun body (10) (as shown in FIG. 2). The driving shaft (28) has a connecting end, a distal end, an enlarged block (282), and a resilient element composed of a hook (284) and a spring (286). The connecting end connects to the nozzle (26). The enlarged block (282) is formed on the distal end and has an inclined face to engage with the gear set. The hook (284) protrudes down from the driving shaft (28). The spring (286) is secured between the hook (284) and an inner stub and longitudinally under the driving shaft (28) to provide a restitution force to the nozzle (26) so as to block the shooting object (162) from entering the recess (12) of the gun body (10).

The second casing (30) is received inside the recess (12) of the gun body (10) and is composed of two symmetrical shells. The second casing (30) has a top, a bottom, a front end, a rear end, a top slit defined in the top and a bottom slit defined in the bottom. The second casing (30) contains a gear set, a trigger (34), a switch (36) and a levering lock (38).

The gear set comprises a miter gear (322) driven by an electrical motor (not shown), a reduction gear (324), and a half-toothed gear (326). The reduction gear (324) is rotatably connected with the miter gear (322). The reduction gear (324) has a large gear (3242) engaged with the miter gear (322) and a small gear (3244) coaxially mounted on the large gear (3242) to engage with the half-toothed gear (326). Thereby, rotation speed of the miter gear (322) rapidly driven by the electrical motor (not shown) is reduced at the reduction gear (324). The half-toothed gear (326) is composed of a lower gear (3261) and an upper gear (3262) slightly larger than the lower gear (3261). The lower gear (3261) engages with the small gear (3244) to make the half-toothed gear (326) rotate with the reduction gear (324). The upper gear (3262) has a flat face, a driving block (3264), an annular periphery, multiple teeth (3266) partially formed on a first portion of the annular periphery, and an idle area formed on a second portion of the of the annular periphery. The driving block (3264) is formed on the flat face of the upper gear (3262) and operationally abuts with the inclined face of the enlarged block (282) on the driving shaft (28). The multiple teeth (3266) are formed on a half periphery of the upper gear (3262) and engage with the toothed rack (222) under the piston body (22). The remaining half of the periphery of the upper gear (3262) is the idle area and does not contact with the toothed rack (222). Thereby, when the half-toothed gear (326) rotates counterclockwise, the teeth (3266) drive the piston body (22) closer to the rear end of the first casing (20) to compress the spring (24). Meanwhile, the driving shaft (28) is pushed backward when the driving block (3264) moves in radian according to the rotation of the half-toothed gear (326). When the driving shaft (28) moves backward, the nozzle (26) also moves aside to allow the rising shooting object (162) to enter the gun body (10).

Figure 5:
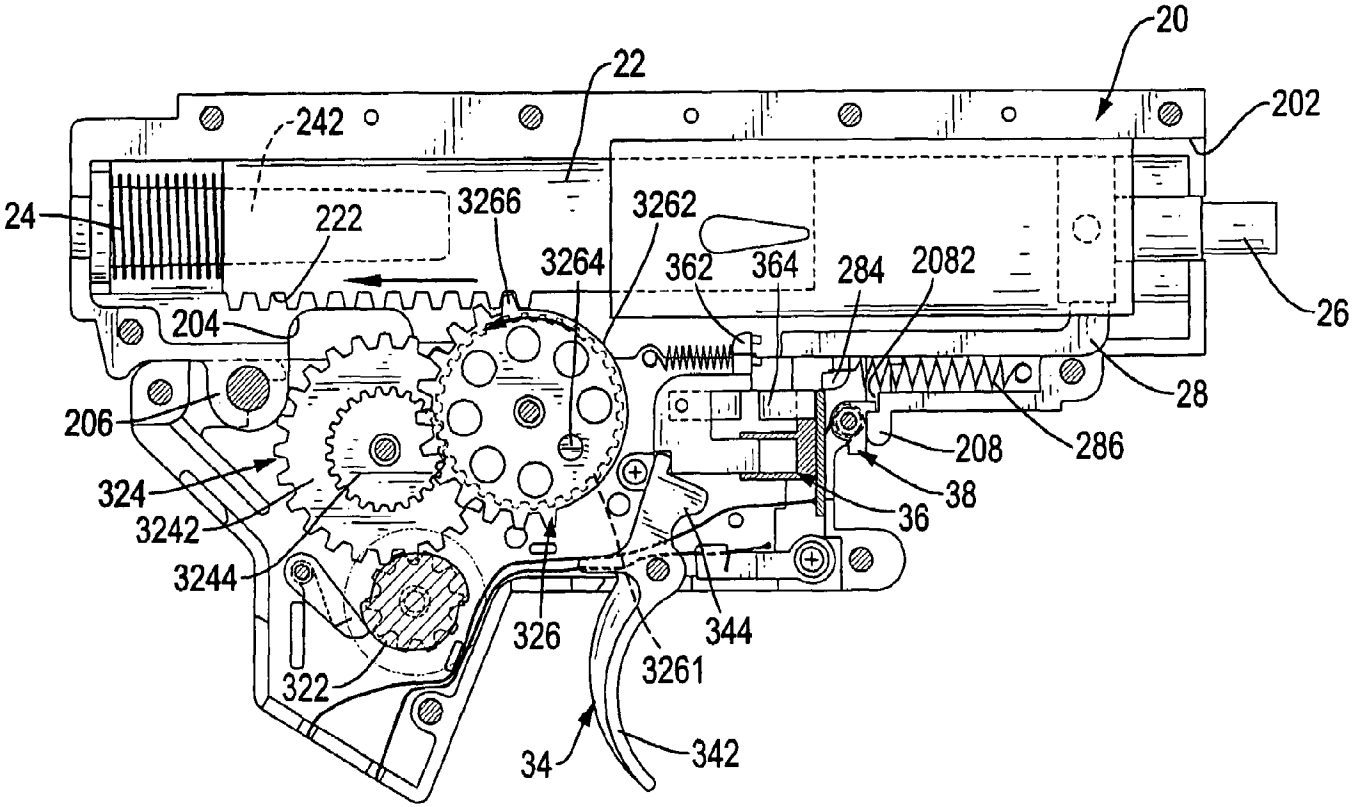
FIG. 5 is another operational cross-sectional side view of the detachable driving assembly in FIG. 4, wherein a half-toothed gear runs to a terminal tooth to maximize a restitution force.
Figure 6:
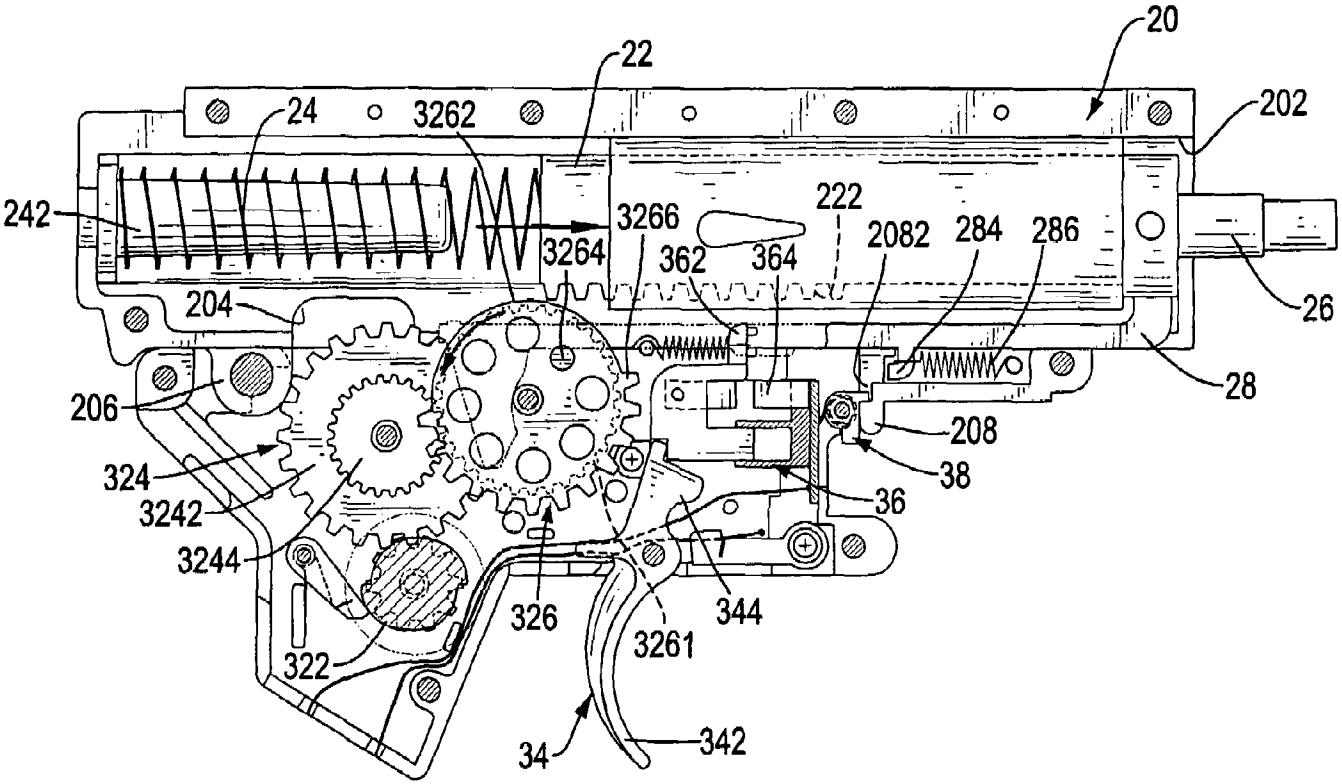
FIG. 6 is still another operational cross-sectional side view of the detachable driving assembly in FIG. 5, wherein the half-toothed gear runs to an idle area to release the restitution force.

With further reference to FIGS. 5 and 6, when the half-toothed gear (326) rotates tooth by tooth, the driving block (3264) moving in radian gradually slides out of the inclined face on the enlarged block (282) of the driving shaft (28). Therefore, the driving shaft (28) is released and moves forward to abut the elevated shooting object (162) because of the restitution force from the spring (286) under the driving shaft (28). When the teeth on the upper gear (3262) run out to disengage with the toothed rack (222), the piston body (20) is released and pushed by the spring (24) to punch the shooting object (162) in front of the nozzle (26).

The trigger (34) is pivotally attached inside the second casing (30) and has a lower pushing bar (342) and an upper abutting block (344). The lower pushing bar (342) extends out of the second casing (30) via the bottom slit so that a user can pull the trigger to activate the toy gun. The upper abutting block (344) operationally touches the switch (36) when the lower pushing bar (342) is pulled.

The switch (36) is accommodated at the front end inside the second casing (30) and composed of a movable block (362) and a stationary block (364). When the trigger (34) is pulled to make the upper abutting block (344) push the movable block (362), the movable block (362) moves forward to touch the stationary block (364) to achieve an electrical connection. Then, the electrical motor (not shown) is activated to drive the gear set to shoot the shooting object (162).

Figure 7:
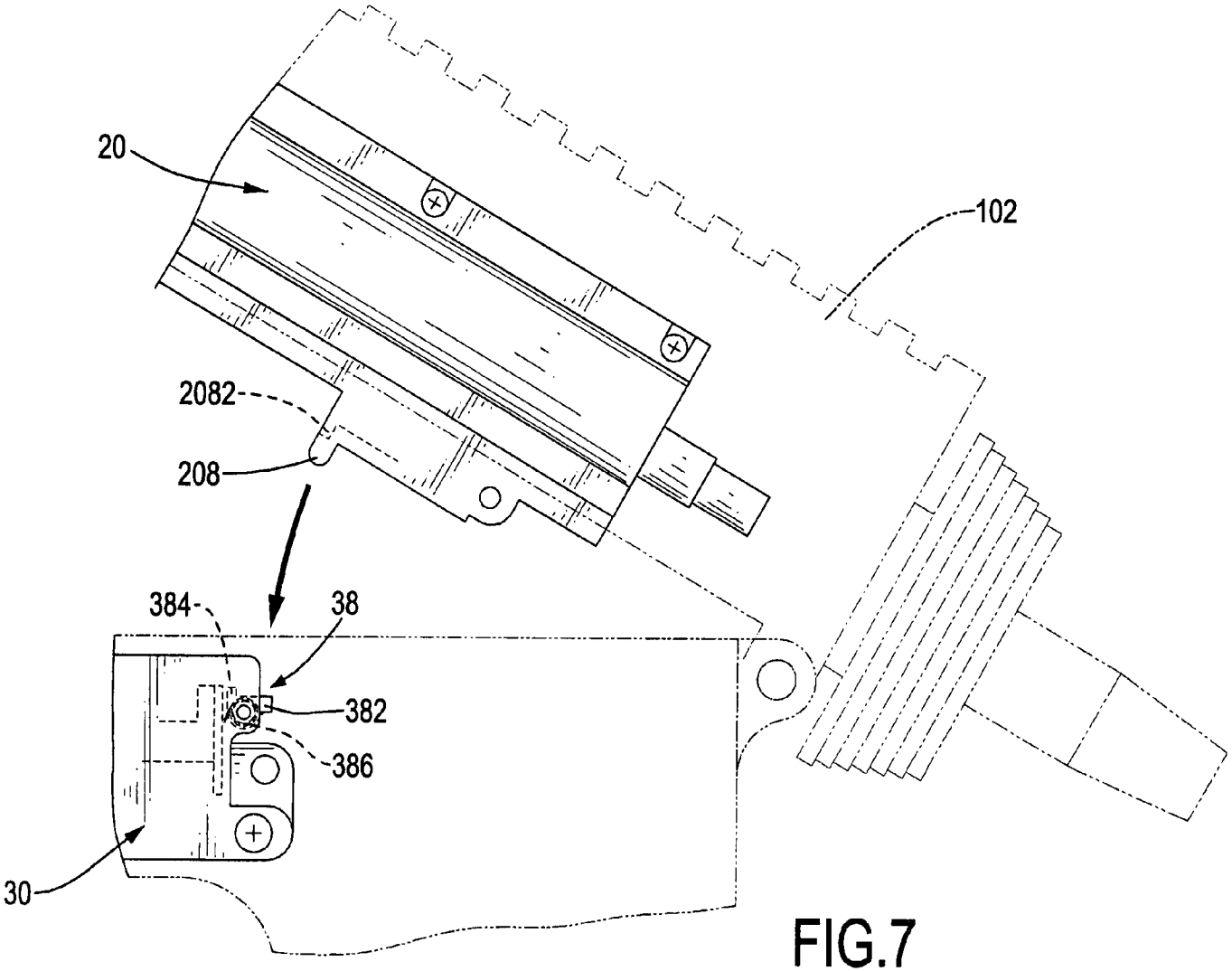
FIG. 7 is an operational side view of attachment of the detachable driving assembly in accordance with FIG. 2.
Figure 8:
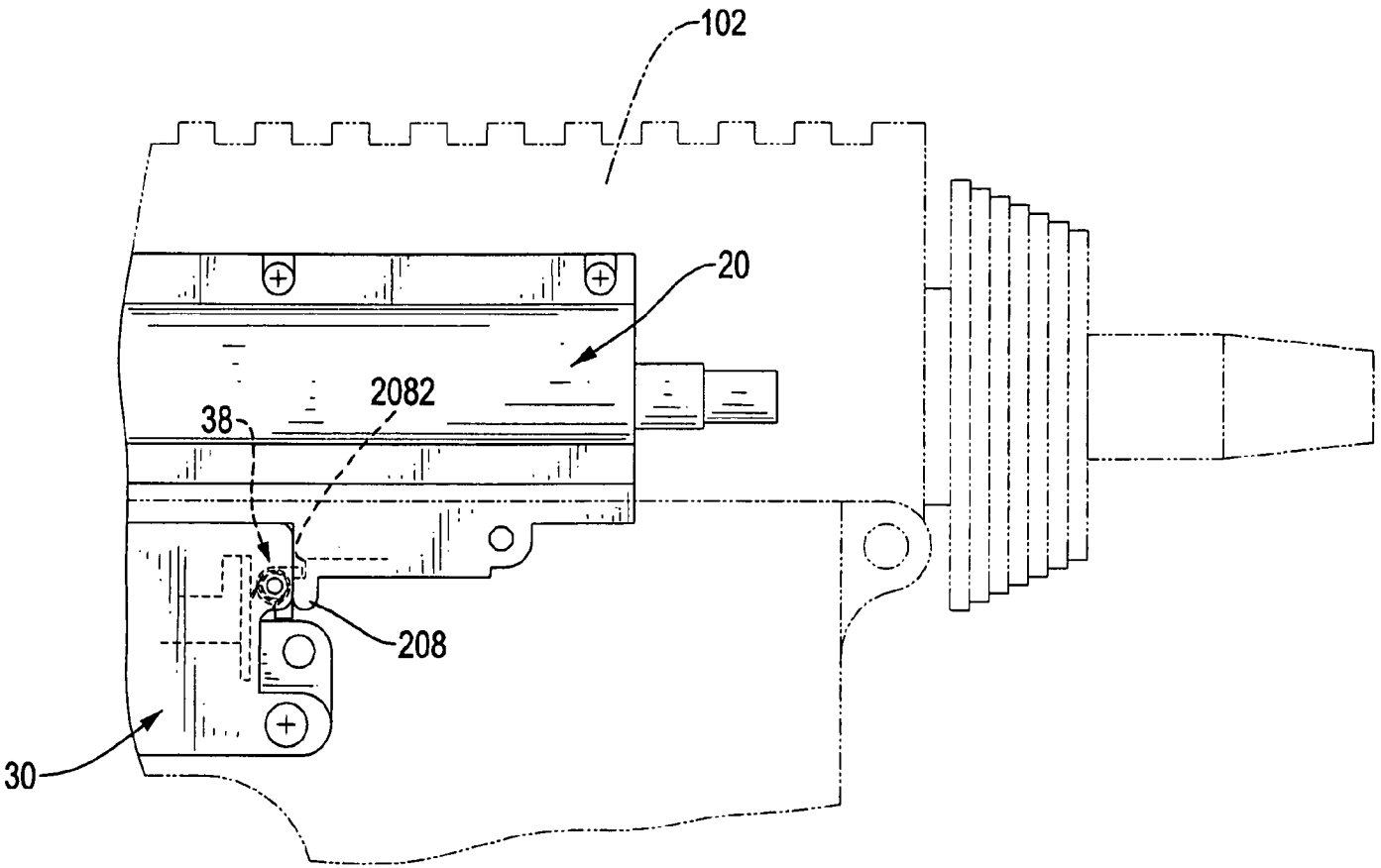
FIG. 8 is another operational side view of the attachment of the detachable driving assembly in accordance with FIG. 2.

With reference to FIGS. 7 and 8, the levering block (38) serves as an engaging element to combine the first casing (20) and the second casing (30) and is pivotally attached at the front end of the second casing (30). The levering block (38) has a pivotal axle, a driven end (382), a resting end (384) perpendicular to the driven end (382) and an optional torsional spring (386) surrounding the pivotal axle. When the first casing (20) is firmly received inside the cover (102) which is pivotally secured on the body (11) at a front end. The first case (20) is detachably combined with the second casing (30), when the cover (102) pivots to move its rear end to close the body (11) until the cover (102) completely close the recess (12). Wherein, the sheet (206) on the first casing (20) inserts into the second casing (30) via the top slit on the top of the first casing (20). A pin (207, in FIG. 1) penetrates the gun body (10), the second casing (30) and the sheet (206) to engage the first casing (20) on the second casing (30) at the rear end of the gun body (10). Then, the front end of the first casing (20) is pressed down to make the distal end of the abutting arm (208) abut the driven end (382) to push the levering block (38) to rotate. After the first casing (20) completely engages with the second casing (30), the levering block (38) is driven to rotate 90° to make the resting end (384) match with the cutout (2082) on the distal end of the abutting arm (208). Thereby, the levering block (38) provides a guiding efficiency to the abutting arm (208) to allow the first casing (20) to slide down to completely engage with the second casing (30). The torsional spring (386) surrounds the pivotal axle of the levering block (38) and has two ends to respectively abut an inner wall of the front end and the driven end (382). Therefore, the torsional spring (386) provides a restitution force to the levering block (38) to rotate the levering block (38) back to an original position after the first casing (20) is removed from the second casing (30). Moreover, the levering block (38) also provides a locking efficiency when the resting end (384) forcibly engages with the cutout (2082).

According to the foregoing description, the driving assembly in the present invention can be detached conveniently to separate the first and second casings (20, 30) so that the toy gun can be easily repaired.

Although the invention has been explained in relation to its preferred embodiment, many other possible modifications and variations can be made without departing from the spirit and scope of the invention as hereinafter claimed.

What is claimed is:

1. A detachable driving assembly for a toy gun, the detachable driving assembly comprising:

a first casing (20) being cylindrical barrel and having a front end, a front opening (202), a rear end, a bottom, a bottom slit (204), a sheet (206) formed on the bottom at the rear end, and an abutting arm (208) extended from the bottom at the front end, wherein the first casing (20) comprises:

a piston body (22) transversally received inside the first casing (20) and having a bottom and a toothed rack (222) formed on the bottom of the piston body (22);

a spring (24) received inside the first casing (20) between the piston body (22) and the rear end of the first casing (20);

a nozzle (26) retractably attached to piston body (22) at the front end of the first casing (20); and a driving shaft (28) movably attached under the piston body (22) and having a connecting end connected to the nozzle (26);

a distal end opposite to the connecting end;

an enlarged block (282) formed on the distal end and having an inclined face; and a resilient element extending between the driving shaft (28) and the front end of the first casing (20);

a second casing (30) composed of two symmetrical shells and having a top, a bottom, a front end, a rear end, a top slit defined in the top and a bottom slit defined in the bottom, wherein the second casing (30) comprises:

a gear set comprising a miter gear (322) adapted to be driven by an electrical motor;

a reduction gear (324) rotatably connected with the miter gear (322) and composed of a large gear (3242) engaged with the miter gear (322) and a small gear (3244) coaxially mounted on the large gear (3242); and a half-toothed gear (326) rotatably connected to the reduction gear (324) and composed of a lower gear (3261) and an upper gear (3262) slightly larger than the lower gear (3261), wherein the lower gear (3261) engages with the small gear (3244) of the reduction gear (324) and the upper gear (3262) has:

a flat face;

an annular periphery;

a driving block (3264) formed on the flat face to abut the inclined face of the enlarged block (282) on the driving shaft;

multiple teeth (3266) partially formed on a first portion of the annular periphery to engage with the toothed rack (222) under the piston body (22); and an idle area formed on a second portion of the annular periphery;

a trigger (34) pivotally attached inside the second casing (30);

a switch (36) accommodated at the front end inside the second casing (30) and activated by the trigger (34); and a levering block (38) pivotally attached at the front end of the second casing (30) and having a pivotal axle attached to the second casing (30);

a driven end (382); and a resting end (384) perpendicular to the driven end (382);

wherein, the first casing (20) is pivotally mounted on the second casing (30) at the rear end of the first casing (20) by inserting the sheet (206) into the second casing (30) via the top slit and pivotally attaching the sheet (206) to the second casing (30); and wherein, the casing (20) is detachably mounted on the second casing (30) at the front end of the first casing (20) by clipping the levering block (38) with the abutting arm (208).

2. The detachable driving assembly as claimed in claim 1, wherein the levering block (38) further has a torsional spring (386) surrounding around the pivotal axle of the levering block (38) to provide a restitution force to the levering block (38).

3. The detachable driving assembly as claimed in claim 1, wherein the first casing (20) further has a spring tube (242) attached at the rear end inside the first casing (20) to partially penetrate the spring (24).

4. The detachable driving assembly as claimed in claim 2, wherein the first casing (20) further has a spring tube (242) attached at the rear end inside the first casing (20) to partially penetrate the spring (24).

5. The detachably driving assembly as claimed in claim 1, wherein the resilient element of the driving shaft (28) comprises:

a hook (284) protruding down from the driving shaft (28); and a spring (286) secured between the hook (284) and an inner stub at the front end of the first casing to longitudinally extend under the driving shaft (28).

6. The detachable driving assembly as claimed in claim 4, wherein the resilient element of the driving shaft (28) comprises:

a hook (284) protruding down from the driving shaft (28); and a spring (286) secured between the hook (284) and an inner stub at the front end of the first casing to longitudinally extend under the driving shaft (28).

7. The detachable driving assembly as claimed in claim 1, wherein the trigger (34) has a lower pushing bar (342) extending out of the second casing (30) via the bottom slit and an upper abutting block (344) operationally touching the switch (36) when the lower pushing bar (342) is pulled.

8. The detachable driving assembly as claimed in claim 1, wherein the switch has a stationary block (364); and a movable block (362) pushed by the upper abutting block (344) of the trigger (34) to contact the stationary block (364) to achieve an electrical connection to adapt to activate the electrical motor.

* * * * *